United States Patent [19]

Langstraat

[11] 4,437,270

[45] Mar. 20, 1984

[54] ABRADING TOOL

[75] Inventor: Warren L. Langstraat, Cottage Grove, Minn.

[73] Assignee: Minnesota Mining and Manufacturing Company, St. Paul, Minn.

[21] Appl. No.: 390,748

[22] Filed: Jun. 21, 1982

Related U.S. Application Data

[63] Continuation of Ser. No. 123,448, Feb. 21, 1980, abandoned, which is a continuation of Ser. No. 914,197, Jun. 12, 1978, abandoned.

[51] Int. Cl.[3] ..... B24B 17/00

[52] U.S. Cl. ..... 51/364; 51/358; 15/230.12; 15/230.19

[58] Field of Search ..... 15/230.12, 230.19; 51/358, 364, 365, 366, 367, 368, 369

[56] References Cited

U.S. PATENT DOCUMENTS

| | | | |
|---|---|---|---|
| 714,244 | 11/1902 | Schmitt | 51/367 |
| 1,885,123 | 11/1932 | Mattison | 51/367 |
| 1,907,904 | 5/1933 | Van Emburg et al. | 51/369 |
| 1,933,685 | 11/1933 | Reed | 51/367 |
| 2,094,894 | 10/1937 | Johnson | 51/364 |
| 2,192,804 | 3/1940 | Schulte | 51/364 |
| 2,221,173 | 11/1940 | Gutsell | 51/374 |
| 2,259,685 | 10/1941 | Elsloo | 51/364 |
| 2,725,694 | 12/1955 | Lukens | 51/364 |
| 3,510,992 | 5/1970 | Hutchins | 51/358 |
| 3,596,411 | 8/1971 | Hutchins | 51/364 |
| 3,916,586 | 11/1975 | Rivas | 51/368 |
| 4,067,149 | 1/1978 | Ali et al. | 51/364 |

FOREIGN PATENT DOCUMENTS

| | | | |
|---|---|---|---|
| 996626 | 9/1951 | France | 51/364 |
| 880818 | 9/1959 | United Kingdom . | |

*Primary Examiner*—E. R. Kazenske
*Assistant Examiner*—Willmon Fridie, Jr.
*Attorney, Agent, or Firm*—Donald M. Sell; James A. Smith; William L. Huebsch

[57] ABSTRACT

A tool including a wheel of a firm material adapted to be rotated by a drive assembly, and a support strip of elastic resilient cellular material permanently adhered around a cylindrical peripheral surface of the wheel with its leading end in a slot in the wheel. A predetermined length of pressure sensitive adhesive coated finishing material may be removably adhered around the outer surface of the support strip with its terminal end in a deeper portion of the slot which is disposed to press the end of the length of finishing material into firm engagement with the leading end of the support strip.

5 Claims, 4 Drawing Figures

ABRADING TOOL

This is a continuation of application Ser. No. 123,448 filed Feb. 21, 1980 which is a continuation of application Ser. No. 914,197 filed June 12, 1978, both now abandoned.

BACKGROUND OF THE INVENTION

This invention relates to tools adapted to releasably support abrasive, polishing or buffing materials (called finishing materials herein) about a cylindrical periphery, and to be rotated to abrade, polish or buff a surface with the supported finishing material.

The prior art is replete with such tools, some of which are adapted to use a circular continuous belt of finishing material. Typically, tools adapted for use with finishing belts have peripheries which can be contracted to allow a belt to be placed around or removed from the periphery, and expanded to hold a belt in place. One such tool described in British Pat. No. 880,818 has a periphery defined by an elastic resilient cellular material which can be manually compressed to put a belt in place and then allowed to expand to hold the belt about its periphery. While such a wheel may provide a desired conformability of the finishing belt to a workpiece, the belts which it uses are expensive compared to equivalent lengths of comparable finishing material, and each such tool of a different diameter requires a separate stock of belts.

Other known prior art tools have been adapted to use less expensive predetermined lengths of finishing material which are attached by engaging one or both of their ends in slots opening through the cylindrical peripheries of the tools. For example, see U.S. Pat. No. 1,907,904, 2,259,685, and 2,725,694; and 2,192,804 which describes such a tool having a rubber outer layer on which the strip is supported. Also U.S. Pat. No. 4,067,149 describes such a tool in which a leading end of a predetermined length of finishing material is inserted in a slot in the periphery of the wheel, and the length of finishing material is removably held in place around the periphery of the wheel by a coating of pressure sensitive adhesive on the finishing material.

While all of these tools may adequately hold a length of finishing material so that it may be applied to a surface, they all support the finishing material on a surface which is so hard that the finishing material cannot effectively conform to a concave or convex surface of a workpiece; and that when the finishing material is abrasive, one of its edges can gouge the workpiece if the axis of the wheel is tipped out of parallel with the surface of the workpiece. Also, many of these tools have a complex means for holding the strip of finishing material that adds substantially to the cost of the tool and to the time needed to attach or replace the strip of finishing material.

SUMMARY OF THE INVENTION

The present invention is a tool of the type adapted to releasably support a predetermined length of finishing material about a cylindrical periphery, which tool provides an inexpensive, convenient effective means for releasably holding the finishing material about its periphery; and allows the finishing material to conform to a planar concave or convex surface on a workpiece so that when abrasive finishing materials are used, a high cutting rate will be achieved while the original contour of the surface is maintained, and so that abrasive finishing material will not gouge the workpiece when the axis of the tool is tipped out of parallel with the surface of the workpiece.

According to the present invention there is provided a tool including a wheel of a firm material adapted to be rotated about its axis by a drive assembly, a support strip at least 0.3 cm (⅛ inch) thick of elastic resilient cellular rubber material with a compression-deflection reading of up to 90 kilopascals (13 pounds per square inch), preferably in the range of 34 to 62 kilopascals (5 to 9 pounds per square inch), fixed around a cylindrical periphery of the wheel to define a cylindrical outer surface of the tool, and means for releasably supporting a predetermined length of finishing material about the periphery. The resilient compressible support strip of at least that minimum thickness (and preferably of 0.6 cm (¼ inch) thickness) allows the finishing material supported thereon to conform to a surface being finished whether it is planar, convex or concave, even when the axis of the wheel is tipped somewhat out of parallel with the surface, while the firm wheel provides sufficient axial stability for the support strip so that its repeated deflection as the wheel rotates will not work the finishing material axially off its periphery.

Preferably the means for releasably holding the finishing material is adapted to receive strips of finishing material coated with pressure sensitive material, and comprises an outer skin layer on the cellular rubber defining the outer surface of the tool and having a surface pattern that is partially recessed to provide only the amount of adhesion between the pressure sensitive adhesive and the cellular rubber which is needed to hold the finishing material in place while allowing the finishing material to be peeled away without delaminating the finishing material or removing portions of the surface layer; and a slot transverse of and opening through the peripheral surface of the wheel. The slot has an outer portion in which is fixed a leading end of the support strip with a space between the outer surface and the adjacent surface of the wheel adapted to receive a portion of the length of finishing material therebetween; and an inner portion adapted to receive a terminal end of that length of finishing material. The inner portion of the slot is disposed to press the adhesive coating on the length of finishing material into firm engagement with the leading end portion of the support strip in the slot to keep it from working longitudinally out of the slot as the wheel is used, while spacing the adhesive coating from the end of the support strip at the juncture between the inner and outer portions of the slot to prevent adhesion therebetween which might cause the support strip to be delaminated or to be separated from the tool when the finishing material is peeled away.

It has been found that the angle at which the end portion of the support strip within the slot is disposed with respect to a radius to the wheel has a significant effect on the proper operation of the wheel. With the end portion disposed along the radius (i.e., a zero angle with respect thereto) the wheel runs smoothly against a surface as the slot moves across it, however the leading portion of the finishing material around the outer surface of the tool will wear excessively just adjacent the slot. Apparently this wear occurs because of the flexing of the underlying cellular rubber support strip at the bend where it enters the slot, which flexing occurs each time that portion of the support strip moves across a surface being finished. When the end portion is disposed at an angle approaching a tangent to the periphery of the wheel, the finishing material is not worn excessively adjacent the slot. The width of the resultant slot, however, provides a flat along the periphery of the wheel that causes the wheel to jump when the slot moves across a surface being finished.

It has been found that disposing the exposed surface of the end portion of the support strip within the slot at an obtuse angle with respect to the exposed outer surface of the adjacent portion of the support strip on the outer surface of the wheel that is connected to the end portion of the support strip in the slot and at an angle in the range of 10 to 35 degrees (preferably 30 degrees) with respect to the radius produces the desirable combination of a smooth running wheel and no excessive wear of the finishing material adjacent the slot.

For any angle of the end portion with respect to the radius of the wheel, it has also been found that when the end of the finishing strip is simply adhered to the end of the support strip in the slot flexing of the support strip tends to loosen the bond between the adhesive coating on the finishing material and the end portion of the support strip so that the end portion of the finishing strip works out of the slot.

This will not occur, however, when means are provided for pressing the adhesive coating on the finishing material into firm engagement with the leading end portion of the support strip, which means in the present invention comprises an inner portion of the slot which is defined by wall means adapted to position the end portion of the finishing material at a larger angle with respect to the radius of the wheel than the surface of the support strip in the slot. This arches the portion of the finishing strip over the support strip in the slot in a direction to press it into firm engagement with the support strip.

The cellular rubber material used in the support strip may be of open or closed cell construction, and should produce a compression-deflection reading of less than 90 kilopascals (13 pounds per square inch), and preferably in the range between 34 to 62 kilopascals when it is tested in accordance with ASTM Designation D 1056-73. Known cellular rubbers having a compression-deflection reading below 34 kilopascals have insufficient internal strength so that they sometimes delaminate when the finishing material is peeled away, or when the tool is operated at high speeds. Known cellular rubber having a compression-deflection reading between 62 and 90 kilopascals do not cut or conform to the work as well as those with readings below 62 kilopascals, and produce some gouging when the wheel is tipped so that its axis is no longer parallel with the surface being finished; whereas with those having a compression-deflection reading above 90 kilopascals, this lack of conformability and cutting rate, the tendency to gouge and problems conforming the material to the wheel are so severe that the material becomes unsuitable.

In the preferred compression-deflection range, however, the material has sufficient internal strength to prevent delamination of the support strip under normal operating conditions, while allowing it to conform to a surface being finished so that it produces a high cutting rate, can conform to concave or convex surfaces, and will not gouge when the axis of the wheel is tipped slightly out of parallel with the surface being finished.

Suitable cellular rubbers for use in the support strip include the closed cell neoprene rubber commercially designated R-1559-N (ASTM material identification RE-42-El) with a skin layer designated Petite 3 DIS which is available from Rubatex, Bedford, W.Va.; or the open cell neoprene rubber designated 572-N (ASTM material identification SCO-12) available from Groendyke Manufacturing Company, Inc., Buchanan, Va.

BRIEF DESCRIPTION OF THE DRAWING

The tool will be further described with reference to the accompanying drawing in which like numbers refer to like parts in the several views and wherein.

DESCRIPTION OF THE PREFERRED EMBODIMENT

Figure 1:
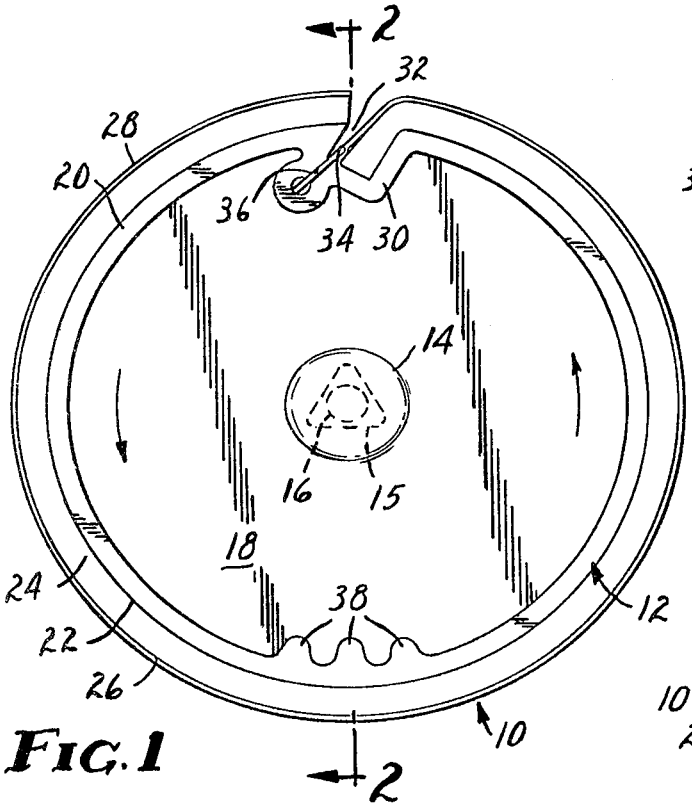
FIG. 1 is a front elevational view of a tool according to the present invention supporting a length of finishing material about its periphery.
Figure 2:
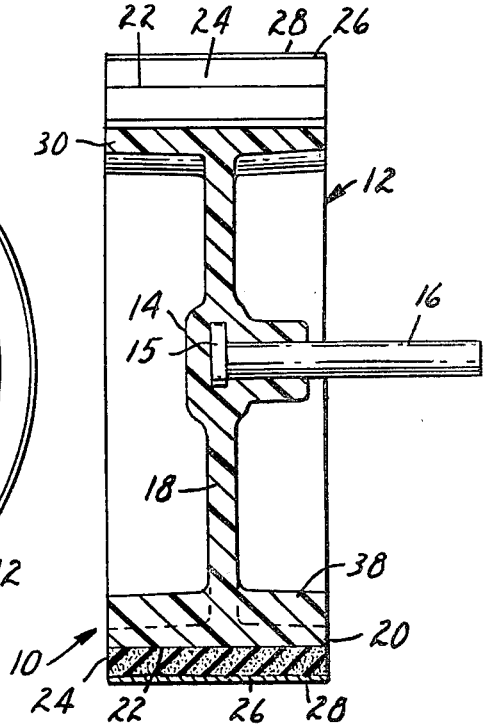
FIG. 2 is a sectional view taken along lines 2—2 of FIG. 1.
Figure 4:
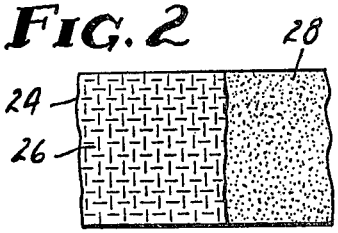
FIG. 4 is a reduced fragmentary side view of the tool and finishing material shown in FIG. 1.
Figure 3:
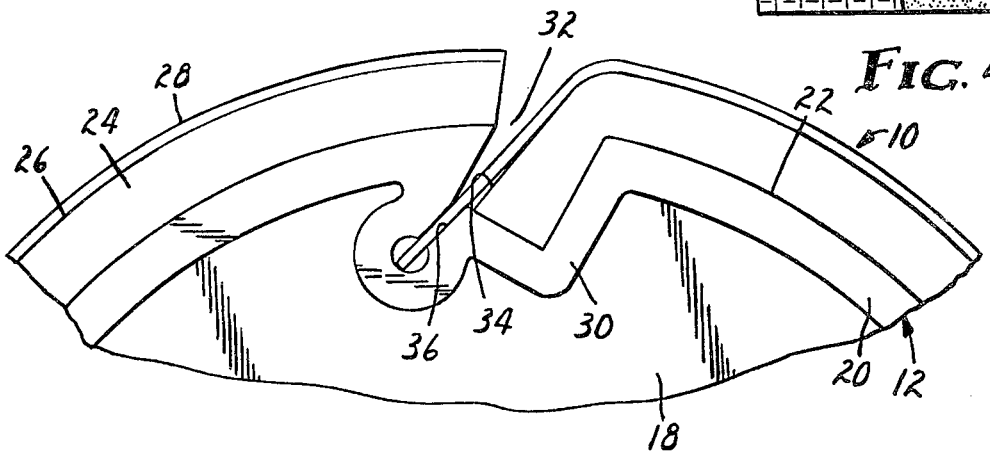
FIG. 3 is an enlarged fragmentary view of the tool and finishing material shown in FIG. 1.

Referring now to the drawing there is shown a tool according to the present invention generally designated by the reference numeral 10. The tool 10 is adapted to be rotated in the direction indicated by the arrow in FIG. 1 by engaging a drive assembly (not shown) with a cylindrical portion 16 of a drive pin; and is adapted to support a predetermined length of finishing material 28 adhered about its outer surface by a coating of pressure sensitive adhesive material on the finishing material so that it may be brought into contact with a surface to be finished.

The tool 10 comprises a wheel 12 molded of a firm material (e.g., a hard ABS copolymer) having a central hub 14 in which is molded a head 15 on the drive pin which has its cylindrical portion 16 projecting from one side of the tool 10 and which provides means adapted for engagement by a drive assembly (such as an electric drill) to rotate the tool 10. Alternatively such means could also be provided by an appropriately sized central opening in the hub 14 so that the hub 14 could be mounted by conventional methods on a driven shaft such as that of a conventional electric grinder. The wheel 12 also has a radially extending flange 18 surrounded by a rim 20 having a cylindrical outer surface 22.

A support strip 24 of elastic resilient cellular rubber material has a major portion fixed (as by a permanent adhesive) around the cylindrical outer surface 22 of the rim 20. The support strip 24 has a skin layer with an outer surface 26 embossed in a regular grid-like pattern of raised and recessed surface portions to provide only the total raised surface area needed for the pressure sensitive adhesive on a strip of finishing material 28 to firmly adhere that finishing material 28 around the outer surface 26 of the support strip 24, without adhering that finishing material 28 firmly that the finishing material 28 or the support strip 24 will be delaminated as the finishing material 28 is peeled away.

The wheel 12 also includes walls 30 extending inwardly of the rim 20 and which, with the rim 20, have surfaces defining a slot 32 transverse of the wheel 12 and opening through the outer surface 22 of the rim 20. The slot 32 includes a wide outer portion 34 in which is fixed an end portion 35 of the support strip 24 which is its leading end portion when the tool 10 is rotated in the direction indicated, and which provides a space between the outer surface 26 of the support strip 24 and the adjacent surface defining the slot 32 that is adapted to receive the finishing material 28 therebetween with its adhesive coating adjacent the end portion 35 of the support strip 24; and an inner portion 36 which is partially defined by parallel opposed surfaces which are closely spaced to receive the terminal end portion of the finishing material 28 therebetween and to direct the terminal end portion so that the adhesive coating on the finishing material 28 adjacent the end portion 35 of the support strip 24 will be pressed into firm engagement therewith while being spaced from the end of the end portion 35. This both insures that the finishing material 28 will not work free of the end portion 35 of the support strip 24 during operation of the tool 10, and that the support strip 24 will not be delaminated or be pulled from the wheel 12 at its end when a length of finishing material 28 is removed from the tool 10. As illustrated these features are provided by disposing opposed surfaces of the inner porton 36 of the slot 32 at a greater acute angle with respect to a radius to the wheel 12 than the exposed surface of the end portion 35 of the support strip 24 (e.g. 45 degrees for the surfaces of the inner portion 36 of the slot 32 as opposed to 30 degrees for the exposed surface of the support strip 24), which will cause the end portion of the finishing material 28 in the slot to arc with its adhesive coating to the outside of the arc and pressed into engagement with the end portion 35 of the support strip 24. Also the innermost of the opposed surfaces defining the inner portion 36 of the slot is spaced from the terminal end of the support strip 24 at the juncture between the inner and outer portions 34 and 36 of the slot 32 to prevent adhesion of the pressure sensitive adhesive on the finishing material 28 to the terminal end of the support strip 24.

The wheel 12 may also include enlarged portions 38 of the rim 20 opposite the walls 30 defining the slot 32, or be otherwise weighted in that area or relieved in others to provide a desired balancing for high speed operation.

In a preferred embodiment the tool 10 adapted for use on ¼ inch drills has an outer diameter of 10.67 cm (4½ inch) which diameter allows it to be driven by most ¼ inch drills without interference between the bodies of the drills and a surface being finished, an axial width at the rim of about 3.8 cm (1½ inch), and a 0.64 cm (¼ inch) thick support strip 24 of cellular rubber with a compression-deflection reading in the range of 35 to 62 kilopascals.

To operate the tool 10 a user first inserts an end of an appropriately sized predetermined length of pressure sensitive adhesive coated finishing material 28 into the inner portion 36 of the slot 32 with the pressure sensitive coat adjacent the support strip 24, whereupon the angle between the portions 34 and 36 of the slot 32 arcs the end portion of the finishing material 28 and presses the pressure sensitive coat thereon firmly against the end portion 35 of the support strip 24. The user then wraps the balance of the length of finishing material 28 around the outer surface 26 of the support strip 24 to adhere it in place. The cylindrical portion 16 of the pin can then be engaged in the chuck of a drive assembly and rotated so that the end portion of the finishing material 28 that has not been inserted in the slot 32 is the trailing end portion, and the outer surface of the finishing material 28 can be brought in contact with a surface to be finished as required and caused via pressure to conform thereto by the resilient compressibility of the support material 24 to effect the desired finish.

When the finishing material 28 is to be removed or changed it is merely peeled away, whereupon the end inserted in the slot 32 may be pulled out without the possibility of delaminating or pulling loose the end of the support strip 24 in the slot 32 due to the spacing between that end of the support strip 24 and the adjacent surface of the inner portion 36 of the slot 32.

I claim:

1. In combination, a length of finishing material coated with pressure-sensitive adhesive and having opposite terminal end portions, and an abrading tool, said tool comprising:

a wheel of a firm material having an axis, a rim having a cylindrical outer surface, surfaces fixed relative to said wheel defining an axially extending slot transverse of and opening through said rim, said slot including inner and outer portions with said inner portion being narrower than said outer portion and being defined by parallel opposed surfaces fixed relative to said wheel and spaced to closely receive one of said terminal end portions of said length of finishing material therebetween while affording movement of said terminal end portion into and out of said inner portion, said wheel including means adapted for engagement by a drive assembly to rotate said wheel about said axis in a first direction; and a support strip of elastic, resilient cellular material having a thickness of over 0.3 centimeter, a compression-deflection reading of up to 90 kilopascals, first and second ends, a leading end portion including said first end, a major portion including said second end, a skin layer having a contact surface with a surface pattern adapted for releasable engagement with the pressure-sensitive adhesive on said length of finishing material, and a surface opposite said contact surface fixed to said wheel with said major portion extending around said cylindrical surface, said second end adjacent said slot, and said leading end portion in the outer portion of said slot; the contact surface on said leading end portion being disposed at an obtuse angle with respect to the adjacent contact surface on said major portion, being disposed at an angle with respect to a radius of said wheel of between 10 to 35 degrees, and being spaced from the adjacent surface of said wheel defining the outer portion of said slot to provide clearance for the end portion of a said length of finishing material;

said length of finishing material being adhered to said contact surface by said pressure-sensitive adhesive with one of said terminal end portions projecting into the inner portion of said slot, said inner portion of said slot being disposed at a greater angle with respect to the radius of the wheel than the contact surface on the leading end portion of said strip to direct and press the adhesive coating on the strip of finishing material into firm engagement with the contact surface on said leading end portion of said support strip, and adhesion of the pressure-sensitive adhesive on said finishing material to said contact surface and one of said opposed surfaces defining the inner portion of said slot providing the only means for attaching said length of finishing material to said tool.

2. A combination according to claim 1 wherein the inner portion of said slot is spaced from the first end of said support strip at the juncture between the inner and outer portions of the slot to prevent adhesion of the pressure sensitive adhesive on the length of finishing material to the contact surface at the first end of said support strip.

3. A combination according to claim 1 wherein said support strip is a cellular rubber having a compression-deflection reading in the range of 34 to 62 kilopascals and a thickness of about 0.6 cm.

4. A combination according to claim 1 wherein the contact surface of the leading end portion of said support strip in the outer portion of said slot is disposed at an angle with respect to a radius of said wheel of about 30 degrees.

5. A combination according to claim 4 wherein the opposed surfaces of said inner slot are disposed at an angle with respect to a radius of said wheel of about 45 degrees.

* * * * *